US009943749B2

(12) United States Patent
Cerboneschi

(10) Patent No.: US 9,943,749 B2
(45) Date of Patent: Apr. 17, 2018

(54) DECK FOR A POWERED SKATEBOARD

(71) Applicant: Inboard Technology, Inc., Burlingame, CA (US)

(72) Inventor: Theodore Cerboneschi, San Francisco, CA (US)

(73) Assignee: Inboard Technology, Inc., Burlingame, CA (US)

( * ) Notice: Subject to any disclaimer, the term of this patent is extended or adjusted under 35 U.S.C. 154(b) by 0 days.

(21) Appl. No.: 15/060,509

(22) Filed: Mar. 3, 2016

(65) Prior Publication Data

US 2016/0256767 A1 Sep. 8, 2016

Related U.S. Application Data

(60) Provisional application No. 62/127,776, filed on Mar. 3, 2015.

(51) Int. Cl.

| | |
|---|---|
| ***A63C 17/01*** | (2006.01) |
| ***A63C 17/12*** | (2006.01) |
| ***A63C 17/26*** | (2006.01) |

(52) U.S. Cl.

CPC ..... *A63C 17/12* (2013.01); *A63C 17/01* (2013.01); *A63C 17/017* (2013.01); *A63C 17/26* (2013.01); *A63C 17/015* (2013.01); *A63C 2203/42* (2013.01)

(58) Field of Classification Search

CPC ..... A63C 17/01; A63C 17/012; A63C 17/015; A63C 17/12

See application file for complete search history.

(56) References Cited

U.S. PATENT DOCUMENTS

| | | | | | |
|---|---|---|---|---|---|
| 4,991,066 | A * | 2/1991 | McCowan | B60Q 1/34 | 280/87.042 |
| 4,997,196 | A * | 3/1991 | Wood | A63C 17/01 | 280/87.042 |
| 5,004,256 | A * | 4/1991 | Won | A63C 17/26 | 280/87.042 |
| 5,119,277 | A * | 6/1992 | Copley | A63C 17/26 | 280/87.042 |
| 5,132,883 | A * | 7/1992 | La Lumandier | A63C 17/26 | 280/87.042 |
| 5,160,025 | A * | 11/1992 | Greenawald | B65D 5/56 | 206/204 |
| 5,226,555 | A * | 7/1993 | Kovaleski | B65D 5/566 | 206/521 |

(Continued)

OTHER PUBLICATIONS

International Search Report and Written Opinion issued in International Application No. PCT/US2016/020770, dated May 17, 2016.

(Continued)

*Primary Examiner* — Jacob B Meyer

(74) *Attorney, Agent, or Firm* — Mintz Levin Cohn Ferris Glovsky and Popeo, P.C.

(57) ABSTRACT

A powered skateboard having a skateboard deck formed from a blank core. The skateboard deck has a top surface for supporting a rider of the powered skateboard and a bottom surface configured to facilitate engagement with one or more skateboard trucks. The skateboard deck can include a well in the top surface of the skateboard deck. The well can be adapted to store one of more components of the powered skateboard.

14 Claims, 12 Drawing Sheets

(56) References Cited

U.S. PATENT DOCUMENTS 5,292,141 A * 3/1994 Ekedal ..... A63C 17/26 280/87.042
5,330,026 A * 7/1994 Hsu ..... A63C 17/01 180/181
5,893,425 A * 4/1999 Finkle ..... A63C 17/01 180/180
6,000,721 A * 12/1999 Pfaeffle ..... A63C 17/01 280/11.19
6,050,357 A * 4/2000 Staelin ..... A63C 17/004 180/181
6,131,931 A * 10/2000 Globerson ..... A63C 17/01 280/20
6,431,733 B2 * 8/2002 Seifert ..... A63C 5/03 280/816
6,443,590 B1 * 9/2002 Lovitt ..... A43B 3/00 352/100
6,619,679 B2 * 9/2003 Lan ..... B62K 3/002 180/181
6,629,767 B2 * 10/2003 Osiecki ..... F21L 4/00 362/194
6,646,547 B2 * 11/2003 Chiu ..... G08B 5/004 280/87.042
6,726,523 B2 * 4/2004 Baker ..... A63H 11/10 180/181
6,802,636 B1 * 10/2004 Bailey, Jr. ..... A63C 17/01 280/841
7,048,284 B1 * 5/2006 Seifert ..... A63C 17/01 280/166
7,232,243 B1 * 6/2007 Nassif ..... A63C 5/06 362/249.04
7,445,218 B2 * 11/2008 Esposito ..... A63C 17/26 280/11.203
7,458,435 B2 * 12/2008 Negoro ..... A63C 17/12 180/180
7,712,937 B2 * 5/2010 Grossman ..... B62J 6/00 362/249.02
7,811,217 B2 * 10/2010 Odien ..... A63B 21/0058 482/147
7,942,450 B2 * 5/2011 Kawano ..... A63C 5/003 280/816
8,038,313 B1 * 10/2011 Campbell ..... F21V 33/008 362/183
8,052,293 B2 * 11/2011 Hurwitz ..... A63C 17/01 362/253
8,083,238 B2 * 12/2011 Borges ..... A63C 5/044 280/11.203
8,317,206 B1 * 11/2012 Novitzky ..... A63C 17/008 280/87.042
8,469,569 B1 * 6/2013 Tunnicliffe ..... A63C 17/015 280/87.042
8,480,274 B2 * 7/2013 Wallace ..... F21V 33/008 362/234
8,562,005 B2 * 10/2013 Grossman ..... B62J 6/00 280/87.041
8,662,508 B2 * 3/2014 Grossman ..... B62K 3/002 280/11.203
8,777,442 B2 * 7/2014 Khan ..... F21V 33/008 362/183
8,794,785 B2 * 8/2014 Campbell ..... F21V 33/008 362/183
8,814,403 B2 * 8/2014 Khan ..... F21V 33/008 362/183
8,827,286 B2 * 9/2014 Woncik ..... A63C 17/0006 280/87.042
8,936,263 B2 * 1/2015 Rawlins ..... A63C 17/0093 280/87.042
9,004,213 B2 * 4/2015 Larson ..... A63C 17/012 180/181
9,108,101 B2 * 8/2015 Gilson ..... A63C 5/03
9,302,173 B2 * 4/2016 DiCarlo ..... A63C 17/12
9,387,388 B2 * 7/2016 King ..... A63C 17/12
9,447,962 B2 * 9/2016 Kim ..... A63C 17/26
9,555,315 B2 * 1/2017 Aders ..... A63C 17/12
2004/0163867 A1 * 8/2004 Hillman ..... A63C 17/12 180/180
2004/0257831 A1 * 12/2004 Liao ..... A63C 17/26 362/565
2005/0029767 A1 * 2/2005 Chang ..... A63C 17/01 280/87.042
2005/0139406 A1 * 6/2005 McLeese ..... A63C 17/01 180/180
2005/0275173 A1 * 12/2005 Hernandez ..... B25H 5/00 280/32.6
2006/0032682 A1 * 2/2006 Hillman ..... A63C 17/12 180/65.1
2006/0049595 A1 * 3/2006 Crigler ..... A63C 17/01 280/87.042
2006/0082089 A1 * 4/2006 Rejtano ..... A63B 22/18 280/87.042
2006/0103098 A1 * 5/2006 Esposito ..... A63C 17/26 280/87.042
2006/0176690 A1 * 8/2006 Yuen ..... F21L 4/08 362/200
2007/0035101 A1 * 2/2007 Gregory ..... A63C 17/0086 280/87.042
2007/0194558 A1 * 8/2007 Stone ..... A63C 5/003 280/601
2008/0205048 A1 * 8/2008 Andrews ..... A45C 5/00 362/156
2008/0265539 A1 * 10/2008 Gregorio ..... A63C 17/26 280/87.041
2009/0010021 A1 * 1/2009 Smith ..... B60Q 1/26 362/565
2009/0039609 A1 * 2/2009 Esposito ..... A63C 17/26 280/87.042
2009/0066073 A1 * 3/2009 Kawano ..... A63C 5/003 280/816
2009/0067187 A1 * 3/2009 Jaime, Sr. ..... A63C 17/26 362/544
2009/0108554 A1 4/2009 Boyle et al.
2009/0236841 A1 * 9/2009 Borges ..... A63C 5/044 280/816
2010/0222941 A1 * 9/2010 Chang ..... A63C 17/015 701/2
2011/0031711 A1 * 2/2011 Grossman ..... B62J 6/003 280/87.041
2011/0309772 A1 * 12/2011 Forgey ..... G09F 13/18 315/308
2012/0013094 A1 * 1/2012 Golden-Justice ..... A63C 17/01 280/87.042
2012/0115005 A1 * 5/2012 Stulen ..... A61B 17/00234 429/120
2013/0081891 A1 * 4/2013 Ulmen ..... A63C 17/12 180/181
2013/0131744 A1 * 5/2013 Viavattine ..... H01M 4/02 607/5
2013/0214701 A1 * 8/2013 Forgey, II ..... H05B 37/02 315/307
2013/0228990 A1 * 9/2013 Baldauf ..... A63C 17/26 280/87.042
2014/0176387 A1 * 6/2014 Coles ..... H01Q 1/526 343/841
2014/0262574 A1 * 9/2014 Rodgers ..... A63C 17/12 180/167
2014/0277888 A1 9/2014 Dastoor et al.
2014/0321150 A1 * 10/2014 Sandiford ..... A63C 17/0013 362/545
2014/0332297 A1 * 11/2014 Palacio ..... A63C 17/1427 180/181
2015/0076781 A1 * 3/2015 O'Dea ..... A63C 17/017 280/87.042
2015/0195890 A1 * 7/2015 Forgey ..... G09F 13/18 315/307
2015/0221914 A1 * 8/2015 Page ..... H01M 2/1016 429/82
2016/0114242 A1 * 4/2016 Riley ..... A63C 17/012 180/233

(56) References Cited

U.S. PATENT DOCUMENTS

| | | | | |
|---|---|---|---|---|
| 2016/0184690 | A1* | 6/2016 | Aders | A63C 17/004<br>180/20 |
| 2016/0276639 | A1* | 9/2016 | Tian | A63C 17/26 |
| 2016/0296826 | A1* | 10/2016 | Belcher | A63C 17/12 |
| 2016/0296830 | A1* | 10/2016 | Turner | A63C 17/26 |
| 2017/0007910 | A1* | 1/2017 | Ruschkowski | A63C 17/12 |

OTHER PUBLICATIONS

Spesia, Nick. Bone Brigade 2013 Re-Issue. Blog [On-line]. 2013 [retrieved on Apr. 25, 2016]. Retrieved from the internet: CURL: https://www.skateone.com/forum/index.php?p=/discussion/1205/bone-brigade-2013-re-issues-set-up-to-skate>.

* cited by examiner

DECK FOR A POWERED SKATEBOARD

CROSS-REFERENCE TO RELATED APPLICATION

This application claims priority to and the benefit of U.S. Provisional Patent Application No. 62/127,776, filed on Mar. 3, 2015 and titled "Deck for A Powered Skateboard," the disclosure of which is incorporated by reference in its entirety.

TECHNICAL FIELD

The subject matter described herein relates to skateboards and in particular powered skateboards.

BACKGROUND

Skateboards typically include an elongated board, sometimes referred to as a deck, having an upper surface and a lower surface. The upper surface typically support the feet of a rider of the skateboard and the lower surface typically have two trucks attached to the deck disposed toward either end of the deck. The upper surface may support the rider who is sitting on the skateboard. The trucks typically provide several degrees of freedom to the wheels relative to the skateboard deck, allowing the wheels to roll over uneven ground and facilitate turning of the skateboard by the rider.

Skateboards typically require the rider to provide the propelling force to move the skateboard, usually by the rider having one foot on the deck of the skateboard and another pushing off from the ground.

Some skateboards have been developed that include a power source. The power source may be a gasoline powered engine. Alternatively, the power source may be an electrically-powered motor. Typically, such power sources are appended to the underside of the skateboard deck or rest on top of the skateboard deck. Such power systems adversely affect the distribution of mass and are aesthetically displeasing.

SUMMARY

In one aspect a method of making a skateboard deck for a powered skateboard is provided. The method can include shaping a skateboard deck from a blank core. The skateboard deck can have a top surface for supporting a rider of the powered skateboard and a bottom surface configured to facilitate engagement with one or more skateboard trucks. The skateboard deck can have a longitudinal size and a lateral size, the longitudinal size greater than the lateral size. A well can be formed in the top surface of the skateboard deck. The well can be formed by removing material from the top surface of the skateboard deck. The well can be adapted to store one of more components of the powered skateboard.

A conduit can be formed in the top surface of the skateboard deck. The conduit can be configured to support a wire disposed between the well and an edge of the skateboard deck. The conduit can be formed by milling the conduit into the top surface of surface of the skateboard deck. In some variations, tubes can be disposed in the conduits.

The skateboard deck can be laminated. The skateboard deck can be wrapped in a composite material. The composite material can be cured onto the skateboard deck. The composite material can be deposited over the openings formed by the conduits, closing the conduits to form tubes.

In some variations a socket can be machined into the skateboard deck. The socket can be configured to receive a light assembly.

A well liner can be installed into the well of the skateboard deck.

The one or more components housed in the well and/or well liner of the skateboard deck can include a power source for the powered skateboard, a control module for the powered skateboard, communication equipment, or the like.

A removable well cover can be provided configured to cover the opening formed by the well in the surface of the skateboard deck.

In another aspect a powered skateboard is described. The powered skateboard can include a skateboard deck formed from a blank core. The skateboard deck can have a top surface for supporting a rider of the powered skateboard and a bottom surface configured to facilitate engagement with one or more skateboard trucks. The skateboard deck can include a well formed in the top surface of the skateboard. The well can be adapted to store one of more components of the powered skateboard.

The skateboard deck can include a conduit in the top surface of the skateboard deck. The conduit can be configured to support a wire disposed between the well and an edge of the skateboard deck.

A composite material can be cured onto the surface of the skateboard deck.

A composite material can cover an opening of the conduit disposed in the top surface of the skateboard deck. The composite material can be cured onto the surface of the skateboard deck.

A socket can be disposed on an edge of the skateboard deck. The socket can be configured to receive a light assembly.

The skateboard deck can have a longitudinal size and a lateral size, the longitudinal size greater than the lateral size. The skateboard deck can include reinforcing rails attached to at least a portion of the longitudinal edges of the skateboard deck.

In some variations, a liner can be installed into the well of the skateboard deck.

The powered skateboard can include a well cover. The well cover can be configured to cover the opening formed by the well in the surface of the skateboard deck.

In one aspect, a powered skateboard is described that can comprise a skateboard deck. The skateboard deck can comprise a bottom portion. The bottom portion can have truck mounting portions configured to facilitate engagement with one or more skateboard trucks. The skateboard deck can comprise a top portion. The top portion can have an upper surface. The upper surface can be configured to support a rider of the powered skateboard. The skateboard deck can have a cavity. The cavity can be disposed between the bottom portion and the top portion of the skateboard deck. The cavity can be adapted to store one or more components of the powered skateboard.

In another aspect, a method of making a deck for a powered skateboard is provided. The method for making a deck of a powered skateboard can include providing a first mold for a bottom portion of the skateboard deck. The first mold can provide truck mounting portions. The truck mounting portions can be configured to allow the bottom portion of the skateboard deck to facilitate engagement with one or more skateboard trucks. A second mold can be provided for a top portion of the skateboard deck. The second mold can be configured to cause the top portion of the skateboard deck to have an upper surface to support a rider of the skateboard.

The first mold can be used to create the bottom portion of the skateboard deck from a moldable material. The second mold can be used to create the top portion of the skateboard deck from the moldable material. The first mold and the second mold can be configured to form a cavity between the bottom portion and the top portion of the skateboard deck when the bottom portion and the top portion are coupled together.

The top portion and the bottom portion of the skateboard deck can be coupled together by one or more of sonically securing, using screws, using an adhesive, and/or other coupling methods.

In another aspect, a method of making a deck for a powered skateboard is provided. The method can comprise providing a mold for a skateboard deck having an inner surface. The inner surface can be configured to facilitate molding of a skateboard deck. The skateboard deck can include a top portion adapted to support a rider of the powered skateboard. The skateboard deck can include a bottom portion having truck mounting portions configured to facilitate engagement with one or more skateboard trucks. The skateboard deck can include a cavity between the top portion and the bottom portion of the skateboard deck.

The method of making a deck for a powered skateboard can comprise introducing a moldable material into the mold for the skateboard deck. The moldable material can be caused to coat the inner surface of the skateboard deck. An inflatable bladder can be introduced into the mold for the skateboard deck. The inflatable bladder can be inflated inside the mold to cause the moldable material to be pressed against the inner surface of the mold and take the shape of the inner surface of the mold.

The method of making a deck for a powered skateboard can optionally include forming an aperture in the top portion of the skateboard deck.

In some variations one or more of the following features can optionally be included in any feasible combination. The top portion of the skateboard deck can include an aperture. The aperture can be configured to facilitate access to the cavity between the top portion and the bottom portion of the skateboard deck. The lid can be configured to cover the aperture and provide support to a rider of the powered skateboard. The lid can be configured to be screwed in place to cover the aperture and provide support to the rider. The lid can be configured to attach to the top portion of the skateboard deck via a hinge. The top portion of the skateboard deck can comprise slots to engage with the lid, such that the lid can slide into the slots and cover the cavity of the skateboard deck and support the rider.

The top portion of the skateboard deck can comprise multiple apertures. One aperture can be configured to facilitate access to components of the powered skateboard that can be regularly removed. Such regularly removed components can include a fuel source for the powered deck and/or a container for the fuel source of the powered deck. Another aperture can be configured to facilitate access to components of the skateboard deck that are not regularly removed. Such components not regularly removed can be control systems for controlling the powered skateboard.

The skateboard deck can include one or more conduits. The one or more conduits can be configured to facilitate connections between the power source and the motive source for the skateboard. The one or more conduits can be configured to facilitate connections between an electrical power source disposed in the cavity of the skateboard deck and one or more electric motors.

The components stored in the cavity between the top portion and the bottom portion can include a receiver. The received can be adapted to receive instructions from a user to control the electronic skateboard. Instructions can be received from a transmitter . . . .

The skateboard deck can include a port aperture. The port aperture can be configured to secure an electronic port into the skateboard deck. The electronic port can be one or more of a USB port, a FireWire port, and/or other electronic port. The electronic port can be configured to facilitate communications between an external device and one or more components of the powered skateboard. The electronic port can be configured to facilitate transfer of electrical energy to one or more components of the powered skateboard. The electronic port can be configured to facilitate transfer of electrical energy from one or more components of the powered skateboard to an external device.

The top portion of the skateboard deck can be secured to the bottom portion of the skateboard deck. The top portion of the skateboard deck can be secured to the bottom portion of the skateboard deck by one or more of screws, adhesive, welding, mechanically fastening, and/or other securing mechanism. The top portion of the skateboard deck can be contiguous with the bottom portion of the skateboard deck. The skateboard deck can have a monocoque structure.

The skateboard deck can comprise injection molded plastic. The skateboard deck can comprise comprises carbon fiber. The skateboard deck can comprise forged carbon fiber. The skateboard deck can comprise pre-preg carbon fiber.

The powered skateboard can be electrically powered. The one or more components stored in the cavity between the top portion and the bottom portion can include a power source for providing electric power to one or more electric motors of the electrically-powered skateboard. The power source can include a battery pack.

A battery pack contemplated by the current subject matter can be interchangeable. The battery pack contemplated by the current subject matter can have a width suitable to fit within the cavity of the skateboard deck for the presently disclosed powered skateboard. The battery pack contemplated by the current subject matter can have a length suitable to fit between the front and back truck mounting portions of the skateboard deck. The battery pack contemplated can be configured to be removable from the skateboard deck. For example, when a battery pack has been depleted it can be exchanged for a charged battery pack. The battery pack can have multiple cells. The battery pack can include a casing. The casing can have a shape and/or dimensions adapted to secure the battery pack within one or more cavities of the skateboard deck.

The current subject matter contemplates multiple different battery packs having different amounts of electrical charge stored in them. The multiple different battery packs can comprise an outer case having substantially similar dimensions. The multiple different battery packs having outer cases having substantially similar dimensions can facilitate the multiple different battery packs to be secured within the cavity of the skateboard deck.

The details of one or more variations of the subject matter described herein are set forth in the accompanying drawings and the description below. Other features and advantages of the subject matter described herein will be apparent from the description and drawings, and from the claims. Certain features of the currently disclosed subject matter are described for illustrative purposes only and it should be readily understood that such features are not intended to be limiting. The claims that follow this disclosure are intended to define the scope of the protected subject matter.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

A powered skateboard is provided that includes one or more components of the powered skateboard disposed within the deck of the powered skateboard. The powered skateboard can be electronically powered. An electric motor for providing motive force to the powered skateboard can be disposed in a wheel of the powered skateboard. A battery, for providing electricity to power the electric motor, can be disposed within the deck. A motor control unit can be disposed within the deck of the powered skateboard. Conduits can be disposed throughout the skateboard deck to house electrical wiring to transport the electricity from the battery to the electric motor.

The motor control unit can be configured to control the motor of the powered skateboard, monitor the health of the power source, or battery, of the powered skateboard, facilitate communication with controller, smartphone, and/or other devices capable of communicating with the motor control unit, and/or perform other functions.

The powered skateboard deck can include one or more light sockets for providing warning and/or illuminating lights on the powered skateboard. Conduits can be disposed within the skateboard deck to house electrical wiring between the battery and the one or more lights disposed in the one or more light sockets.

The powered skateboard deck can be coated with a composite material. The composite material can be cured onto the skateboard deck. The composite material can provide strength and resilience to the skateboard deck. The composite material can be placed over one or more conduits disposed in the skateboard deck, causing the conduits to form tunnels between a well for the battery and one or more electrical components.

Figure 1:
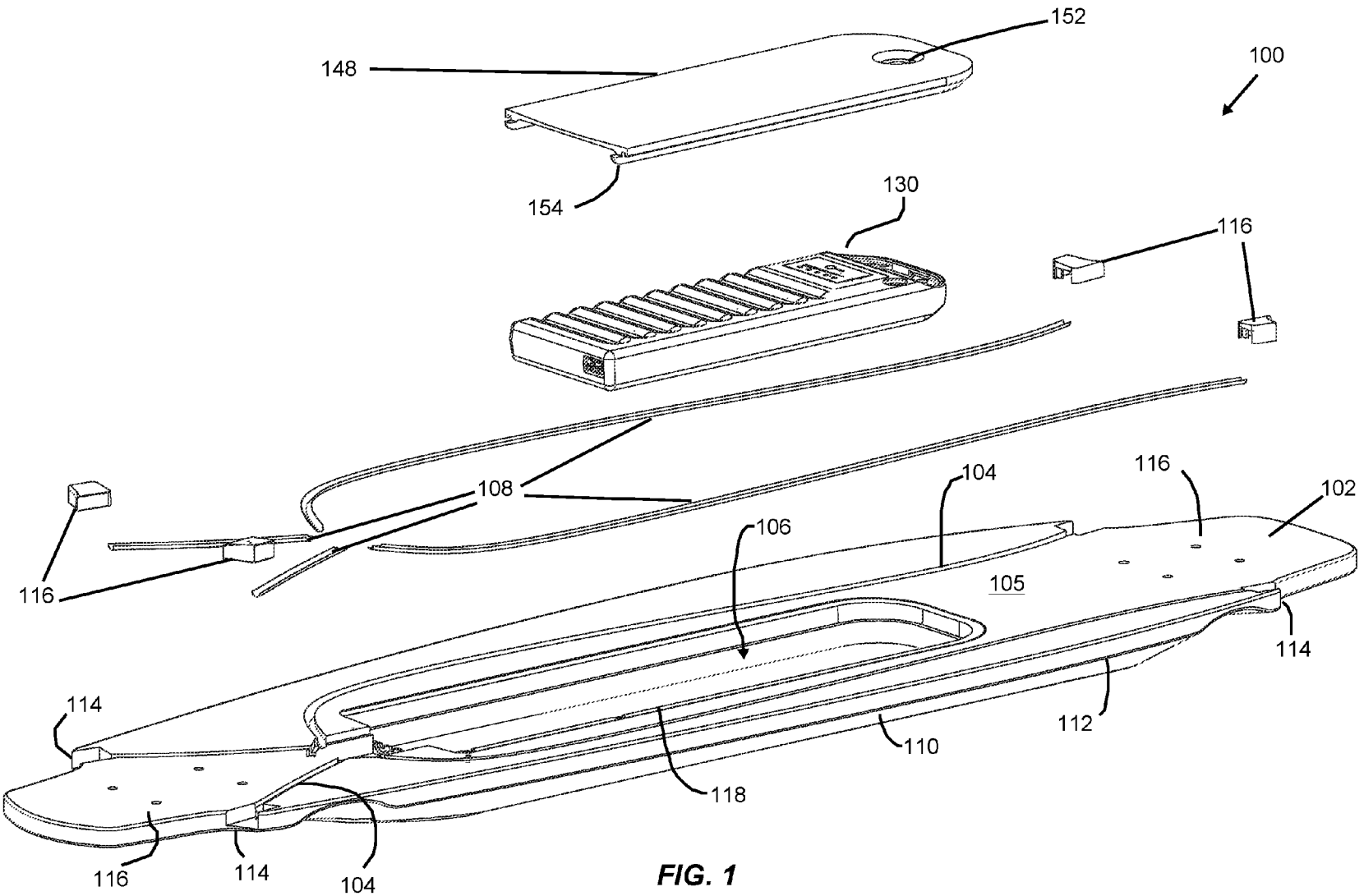
FIG. 1 is a schematic view of some elements of a powered skateboard, having one or more features consistent with implementations of the current subject matter.

FIG. 1 is a schematic view of some elements of a powered skateboard 100, having one or more features consistent with implementations of the current subject matter. The powered skateboard 100 can include a skateboard deck 102. The skateboard deck 102 can be formed from a skateboard deck blank. The skateboard deck blank can be substantially the same size as intended size of the skateboard deck 102. The skateboard deck blank can be greater in size in one or more dimensions than the intended size of the skateboard deck 102. In some variations, the skateboard deck blank can include a similar shape as the intended shape of the skateboard deck 102.

The skateboard deck blank can be formed from wood, foam, composite, plastic, or the like.

The skateboard deck blank can be milled and/or shaped to form the skateboard deck 102. In some variations, a skateboard deck blank can be milled using a computerized numerical control (CNC) machine. The CNC machine can include one or more milling and/or shaping apparatus for milling and/or shaping the skateboard deck blank into a skateboard deck 102 having a desired configuration and/or design.

The skateboard deck 102 can include one or more conduits 104. In some variations, the conduit(s) 104 can disposed within a top portion 105 of the skateboard deck 102. The conduit(s) 104 can be configured to support components of the powered skateboard 100. In some variations the conduit(s) 104 can be configured to support electrical wiring between the well 106 of the skateboard deck 102 and one or more electrical components of the powered skateboard 100.

In some variations, tubing 108 can be disposed within the conduit(s) 104. The tubing 108 can be configured to facilitate passage of an electrical wire there through.

In some variations, reinforcing rails 110 can be disposed on at least a longitudinal edge of the skateboard deck 102.

A composite material 112 can be laminated onto an outer surface of the skateboard deck 102. In some variations, the composite material 112 can be formed from a laminate and/or resin. The composite material 112 can include one or reinforcing materials.

In some variations, one or more graphics can be placed on the skateboard deck 102 prior to and/or during the coating process for the for the composite material 112.

In some variations, the skateboard deck 102, having a composite material 112 adhered onto it, can be placed within a curing oven. Any excess material of the composite material 112 can be trimmed to a proper size for the skateboard deck 102.

A well 106 can be milled into the top surface 105 of the skateboard deck 102. The battery well can be milled through the cured composite material 112. In some variations, the well 106 can be milled into the blank for the skateboard deck 102. The well 106 can be configured to store one or more components of the powered skateboard. The well 106 can be configured to store a control unit, a battery, or the like.

In some variations, the well 106 can be milled into the top surface 105 of the skateboard deck 102 after it has been laminated with then composite material 112.

In some variations, light sockets 114 can be milled into the skateboard deck 102. Electrical wiring can be run from the well 106, through the conduits 104 and the tubing 108.

The light sockets 114 can be configured to receive lenses 116. The lenses 116 can be configured to scatter light emitted by a light emitting device disposed in the light socket 114. In some variations, the light emitting device can include a light emitting diode (LED).

In some variations, the tubing 108 can include a waveguide. A light source can be disposed within the well 106. A waveguide can be disposed between the light source and the light socket 114. In some variations, a single light source can provide illumination to multiple light sockets 114 through a plurality of wave guides.

Truck mounting points 116 can be milled into the skateboard deck 102. In some variations, the truck mounting points 116 can be milled when the skateboard blank is milled into the shape of the skateboard deck 102. In other variations, the truck mounting points 116 can be milled into the skateboard deck 102 after the skateboard deck 102 has been laminated with the composite material 112.

Figure 2:
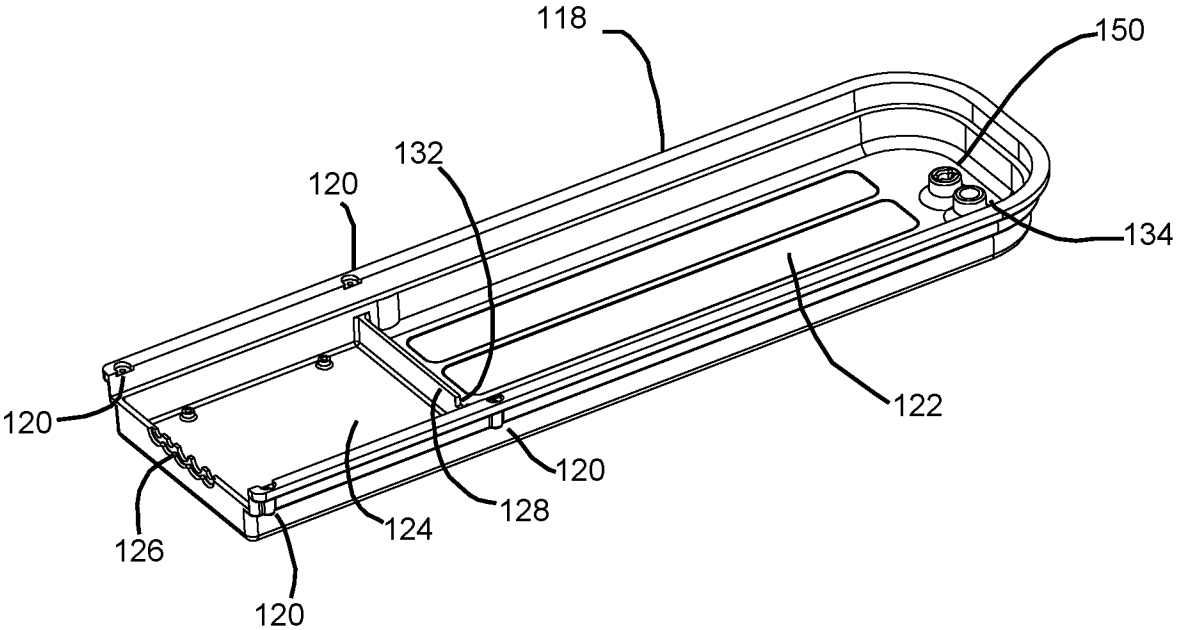
FIG. 2 is an illustration of a well liner for use with a powered skateboard, having one or more features consistent with the present description.

FIG. 2 is an illustration of a well liner 118 for use with a powered skateboard 100, having one or more features consistent with the present description. The well liner 118 can be configured to be disposed within the well 106 formed into the skateboard deck 102. The well liner can include one or more fastener locations 120. The one or more fastener locations 120 can be configured to facilitate securing of the well liner 118 into the well 106 using one or more fasteners. In some variations, the well liner 118 can be secured into the well 106 using an adhesive, pressure fit, or the like. In some variations, the well liner 118 can be integral with the skateboard deck 102.

The well liner 118 can be configured to house one or more components of the powered skateboard 100. For example, the well liner 118 can include a battery cavity 122 configured to house a battery for powering the powered skateboard 100. The well liner 118 can include a control unit cavity 124.

The control unit cavity 124 can be configured to house a control unit for the powered skateboard 100. The control unit can be configured to control a motor of the powered skateboard 100, communicate with a user controller for the powered skateboard 100, communicate with a mobile device of the user or owner of the powered skateboard 100, control one or more components of the powered skateboard, such as the lights of the powered skateboard, or the like. The well liner 118 can include one or more electrical wiring conduits 126. The electrical wiring conduits 126 can be configured to facilitate passage of electrical wiring between the control unit in the control unit cavity 124 and one or more electrical components of the powered skateboard 100. The electrical wiring conduits 126 can be configured to facilitate passage of a waveguide from a light source disposed within the well liner 118.

The well liner 118 can include a separator 128. The separator 128 can be configured to separate different components of the powered skateboard 100. The separator 128 can be configured to separate components of the powered skateboard 100 that are removed or replaced often, for example a battery 130 of the skateboard deck, from components of the powered skateboard 100 that are not regularly removed, for example a control unit for the powered skateboard 100. In some variations, an internal well conduit 132 can be provided in the internal well separator 128 to facilitate connection of one or more components in the battery well 122 with one or components in the control unit cavity 124. For example the internal well conduit 132 can be configured to facilitate connection of the battery 130 with a control unit in the control unit cavity 124.

Figure 3:
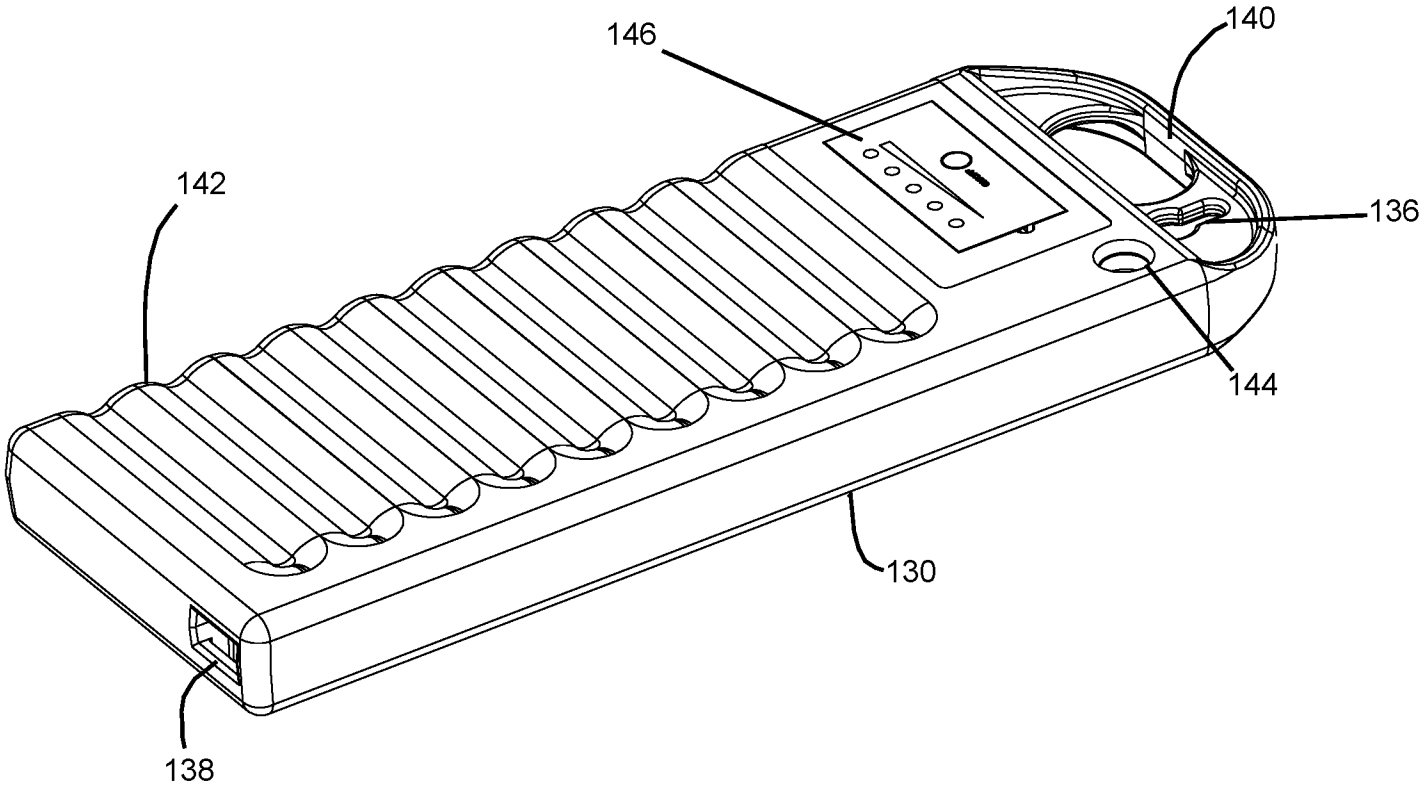
FIG. 3 is an illustration of a battery for use with a powered skateboard having one or more features consistent with the present description.

FIG. 3 is an illustration of a battery 130 for use with a powered skateboard 100 having one or more features consistent with the present description. The well liner 118 can include a battery fastener 134. The battery fastener 134 can be configured to engage with a battery fastener connector 136 of the battery 130. Illustrated is a battery fastener 134 having a male configuration and a battery fastener connector 136 having a female configuration. The present disclosure contemplates battery fastener 134 of the well liner 118 having a female configuration and the battery fastener connector 136 of the battery having a make configuration.

As previously stated, the well liner 118 can be integral with the material of the skateboard deck 102. The features illustrated and described with respect to the well liner 118 can be incorporated directly into the material of the skateboard deck 102.

The battery 130 can be configured to be secured into the battery well 122. The battery 130 can include a battery connector 138. The battery connector 138 can be configured to connect with a complementary connector of a control unit housed within the control unit cavity 124.

The battery 130 can include a handle 140. The handle can be configured to facilitate removing the battery 130 from the well 106.

The battery 130 can include a ribbed surface 142. The ribbed surface 142 can provide an increased surface area allowing increased efficiency in cooling the battery 130 during charging and discharging. The battery 130 can include a charging port 144. The charging port 144 for charging the battery 130.

The battery 130 can include a charge level indicator 146. The charge level indicator 146 can include one or more indicators indicating the level of charge in the batter 130. For example, the charge level indicator 146 can include a plurality of lighted signals indicating the charge. The lighted signals can be different colors indicating different levels of charge of the battery 130.

The battery 130 can be configured to facilitate determination of the level of charge of the battery 130. The level of charge of the battery 130 can be transmitted to a mobile device of the user of the powered skateboard 100. The level of charge of the battery 130 can be transmitted to a mobile device through a control unit of the powered skateboard 100.

Figure 4:
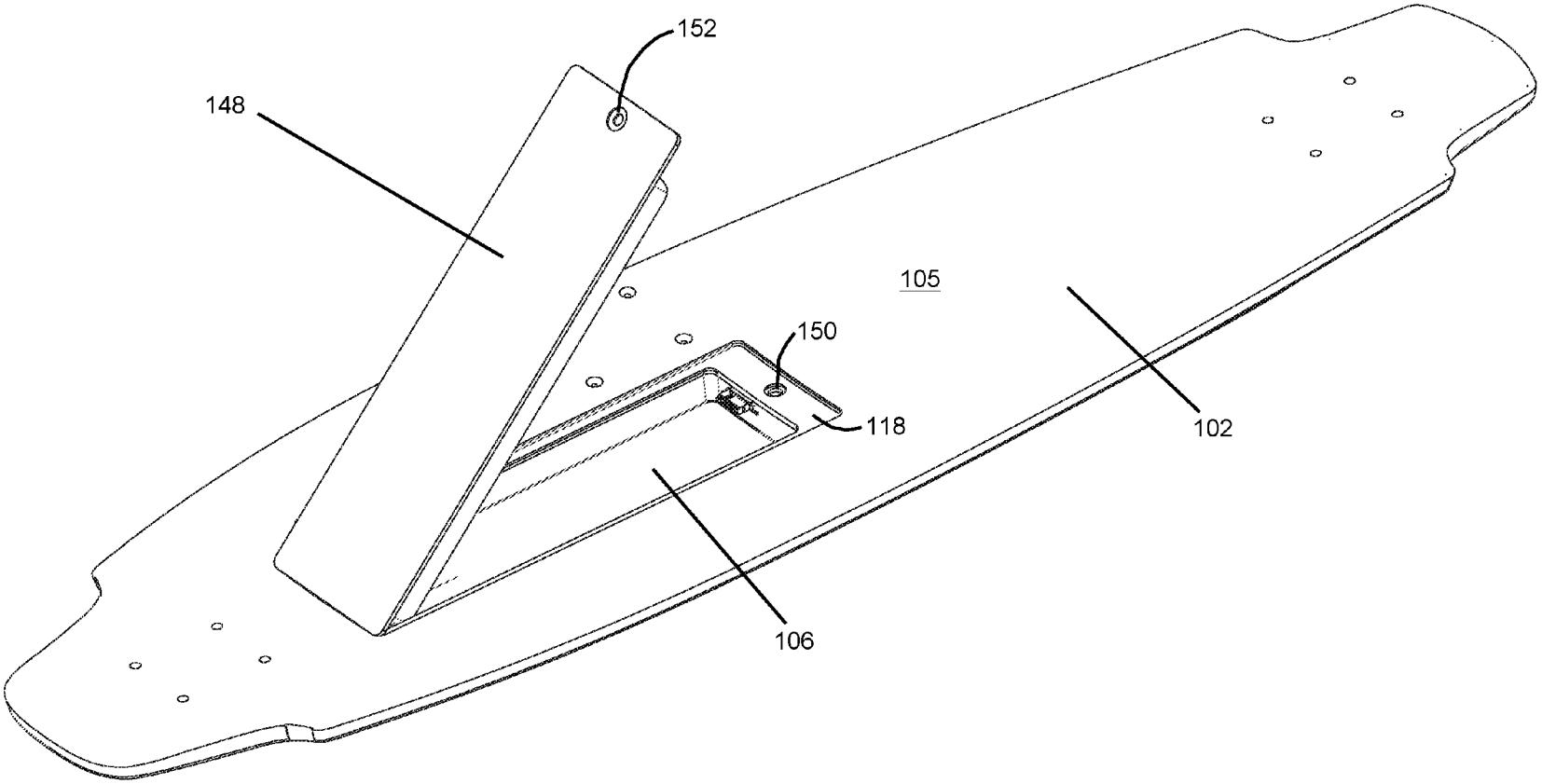
FIG. 4 is an illustration of several components of the powered skateboard having one or more features consistent with the present description.

FIG. 4 is an illustration of several components of the powered skateboard 100 having one or more features consistent with the present description. A well lid 148 can be provided for covering the opening formed by the well 106 on the top surface 105 of the skateboard deck 102. The lid 148 can be configured to, at least partially, support a rider of the skateboard. The lid 148 can be coated in grip tape or the like. The well 106 and/or well liner 118 can include a fastener 150 to secure the lid 148 closed on the skateboard deck 102. The lid 148 can include a complementary fastening portion 152 for engaging with the fastener 150 of the well 106 and/or well liner 118. In some variations, the lid 148 can extend along the length of the well 106.

The lid 148 can include guides 154 configured to engage with at least a portion of the well 106 and/or well liner 118. In some variations, lid 148 can extend along the battery well 122 portion of the well 106 of the skateboard deck 102. A cover can be provided to cover the control unit cavity 124.

In some variations, the well 106 and/or battery well 122 can be configured to inhibit the ingress of water into the well 106 and/or battery well 122. The well liner 118 can be configured to be water tight. A gasket configured to inhibit the ingress of water into the battery well 122 can be provided between the well 106 and/or battery well 122 and the lid 148. In some variations, the well 106, the battery well 122, well liner 118, and/or lid 148 can be waterproof.

Figure 5:
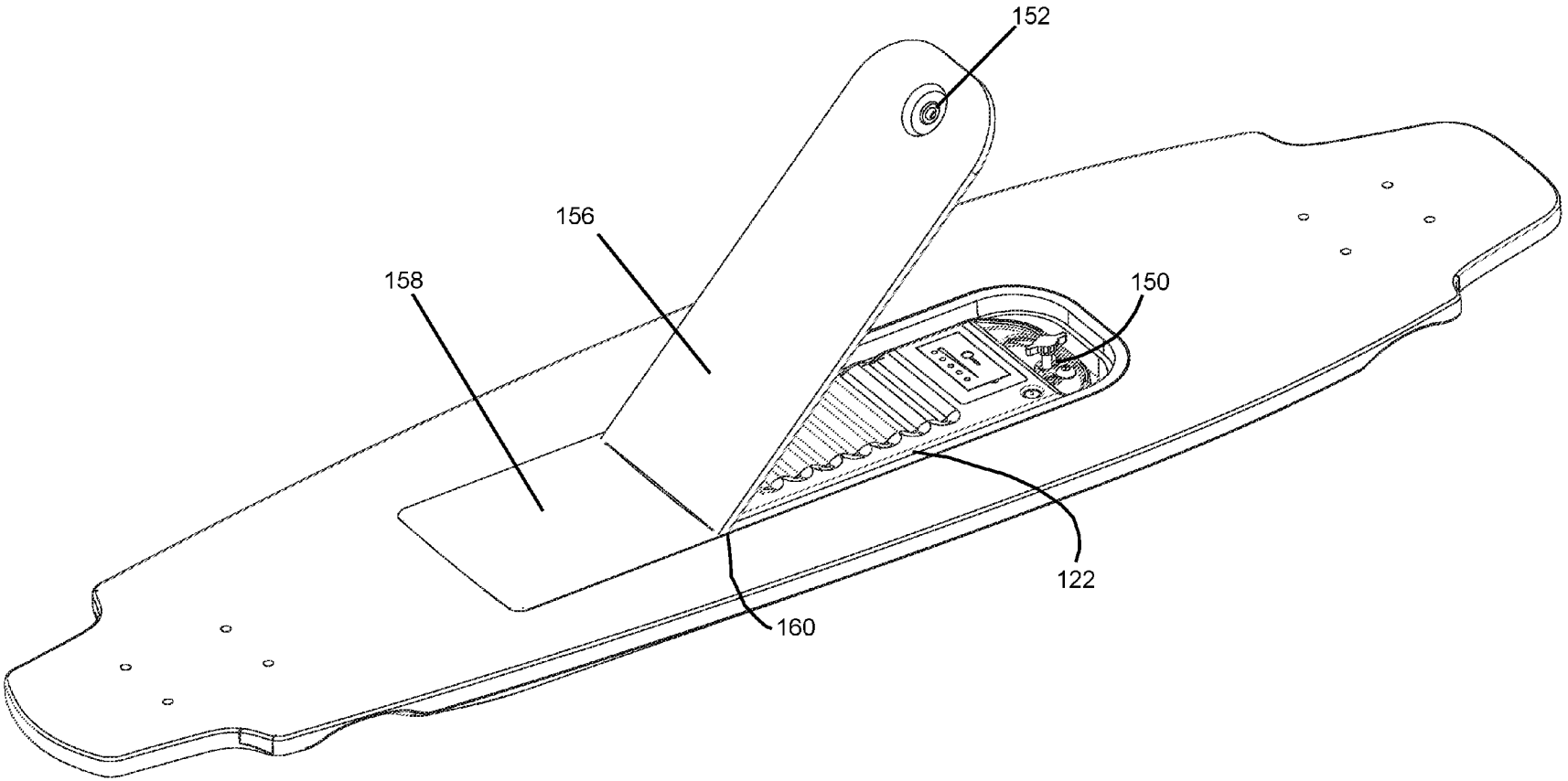
FIG. 5 is an illustration of several components of the powered skateboard having one or more features consistent with the present description.

FIG. 5 is an illustration of several components of the powered skateboard 100 having one or more features consistent with the present description. A lid 156 can be provided that extends along the length of the well 106. The lid can include a removable portion 156 covering the battery well and a fixed portion 158 covering the control unit cavity. A hinged portion 160 can be disposed between the removable portion 156 and the fixed portion 158.

In some variations, the cover for the battery well and the cover for the control unit cavity can be separate structures.

In some variations, the battery 130 and the lid 148 can be integrated. The upper surface of the battery 130 can form the lid for the battery well 122. The upper surface of the battery 130 can be coated with grip tape, or the like.

The cover for the control unit cavity can be fastened to the top surface 105 of the skateboard deck with fasteners, adhesive, or the like. Grip take can be applied to the top surface 105 of the skateboard deck 102 such that the grip tape can extend over the cover for the control unit cover. This can conceal the control unit cover for avoidance of tampering.

Figure 6:
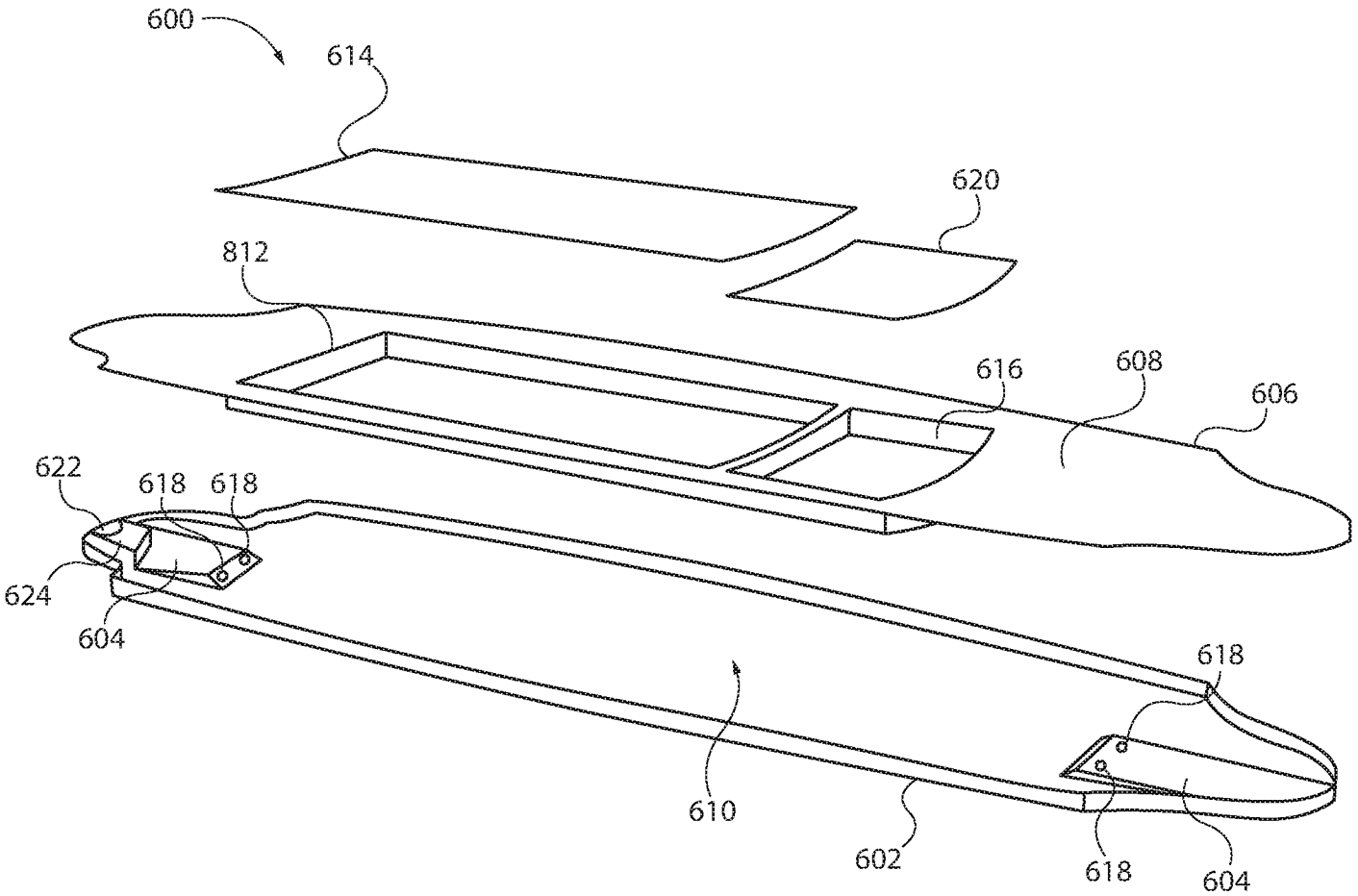
FIG. 6 is a schematic view of various elements of the skateboard deck, having one or more features consistent with the present description.

FIG. 6 is a schematic view of various elements of the skateboard deck 600, having one or more features consistent with implementations of the current subject matter. The skateboard deck can comprise a bottom portion 602. The bottom portion 602 can have truck mounting portions 604 configured to facilitate engagement with one or more skateboard trucks. The skateboard deck 600 can comprise a top portion 606. The top portion 606 can have an upper surface 608. The upper surface 608 can be configured to support a rider of the powered skateboard. The skateboard deck 600 can have a cavity 610. The cavity 610 can be disposed between the bottom portion 602 and the top portion 606 of the skateboard deck 600. The cavity 610 can be adapted to store one or more components of the powered skateboard.

The top portion 606 of the skateboard deck 600 can include an aperture 612. The aperture 612 can be configured to facilitate access to the cavity 610 between the top portion 606 and the bottom portion 602 of the skateboard deck 600.

The bottom portion 606 of the skateboard deck 600 can include support structures. The support structures can be configured to provide support for the top portion 608 of the skateboard deck 600 to facilitate the top portion 608 support a rider of the powered skateboard.

In some variations of the current subject matter, the top portion 606 of the skateboard deck can comprise multiple apertures 612,616. One aperture 614 can be configured to facilitate access to components of the powered skateboard that can be regularly removed. Such regularly removed components can include a fuel source for the powered deck and/or a container for the fuel source of the powered deck. Another aperture 616 can be configured to facilitate access to components of the powered skateboard 610 that are not regularly removed. Such components not regularly removed can be control systems for controlling the powered skateboard.

The components can include a transceiver configured to communicate with one or more mobile devices. The transceiver can be one or more of a WiFi transceiver, a Bluetooth transceiver, a Near-Field-Communication transceiver, a sub-gigahertz transceiver, and/or any other wireless communication transceiver. The transceiver can be in electronic communication with the control system for the powered skateboard. The control system can be configured to modify one or more parameters of the powered skateboard.

A lid 614 can be provided for the aperture. The lid 614 can be configured to cover the aperture 612 and provide support to a rider of the powered skateboard. The lid 614 can be configured to be screwed in place to cover the aperture 612 and provide support to the rider. The lid 614 can be configured to attach to the top portion 606 of the skateboard deck 600 via a hinge, a latch, a connector, or any other connection mechanism. The top portion 606 of the skateboard deck 600 can comprise slots to engage with the lid 614, such that the lid 614 can slide into the slots and cover the aperture 612 of the skateboard deck 600 and support the rider. The lid 614 can be removably engaged with the top portion 606 of the skateboard deck 600.

Having the lid 614 removably engaged with the top portion 606 of the skateboard deck 600 can facilitate a user of the powered skateboard to access one or more components of the powered skateboard stored in the cavity 610. For example, the powered skateboard can be electrically powered. The cavity 610 of the skateboard deck 600 can be configured to store one or more battery packs to provide electrical power to one or more electric motors of the powered skateboard. Having the lid 614 removably engaged with the top portion 606 of the skateboard deck 600 can facilitate a user to exchange a spent battery pack with a charged battery pack. A user can, therefore, be able to continue using the powered skateboard.

In variations where the skateboard deck 600 includes multiple apertures 612, 616, the aperture 616 for providing access to non-regularly removed components of the powered skateboard can be covered by a lid 620. The lid 620 for covering aperture 616 can be secured such that the lid 620 is not easily removed, and can withstand a tumbling of the skateboard or any other shock. The lid 620 for covering aperture 616 can be secured to the top portion 606 of the skateboard deck 600 using screws, adhesive, and/or other securing methods.

The skateboard deck 600 can include one or more conduits 618. The one or more conduits 618 can be configured to facilitate connections between the power source and the motive source for the powered skateboard. The one or more conduits 618 can be configured to facilitate connections between an electrical power source disposed in the cavity 610 of the skateboard deck 600 and one or more electric motors disposed outside of the cavity 610 of the skateboard deck 600.

The components stored in the cavity 610 between the top portion 606 and the bottom portion 602 of the skateboard deck 600 can include a receiver. The receiver can be adapted to receive instructions from a user to control the powered skateboard. Instructions can be received from a transmitter. The transmitter can include a hand-held transmitter.

The skateboard deck 600 can include a port aperture 622. The port aperture 622 can be configured to secure an electronic port 624 into the skateboard deck 600. The electronic port 624 can be one or more of a USB port, a FireWire port, and/or other electronic port. The electronic port 624 can be configured to facilitate communications between an external device and one or more components of the powered skateboard. The electronic port 624 can be configured to facilitate transfer of electrical energy to one or more components of the powered skateboard. The electronic port 624 can be configured to facilitate transfer of electrical energy from one or more components of the powered skateboard to an external device.

Figure 7:
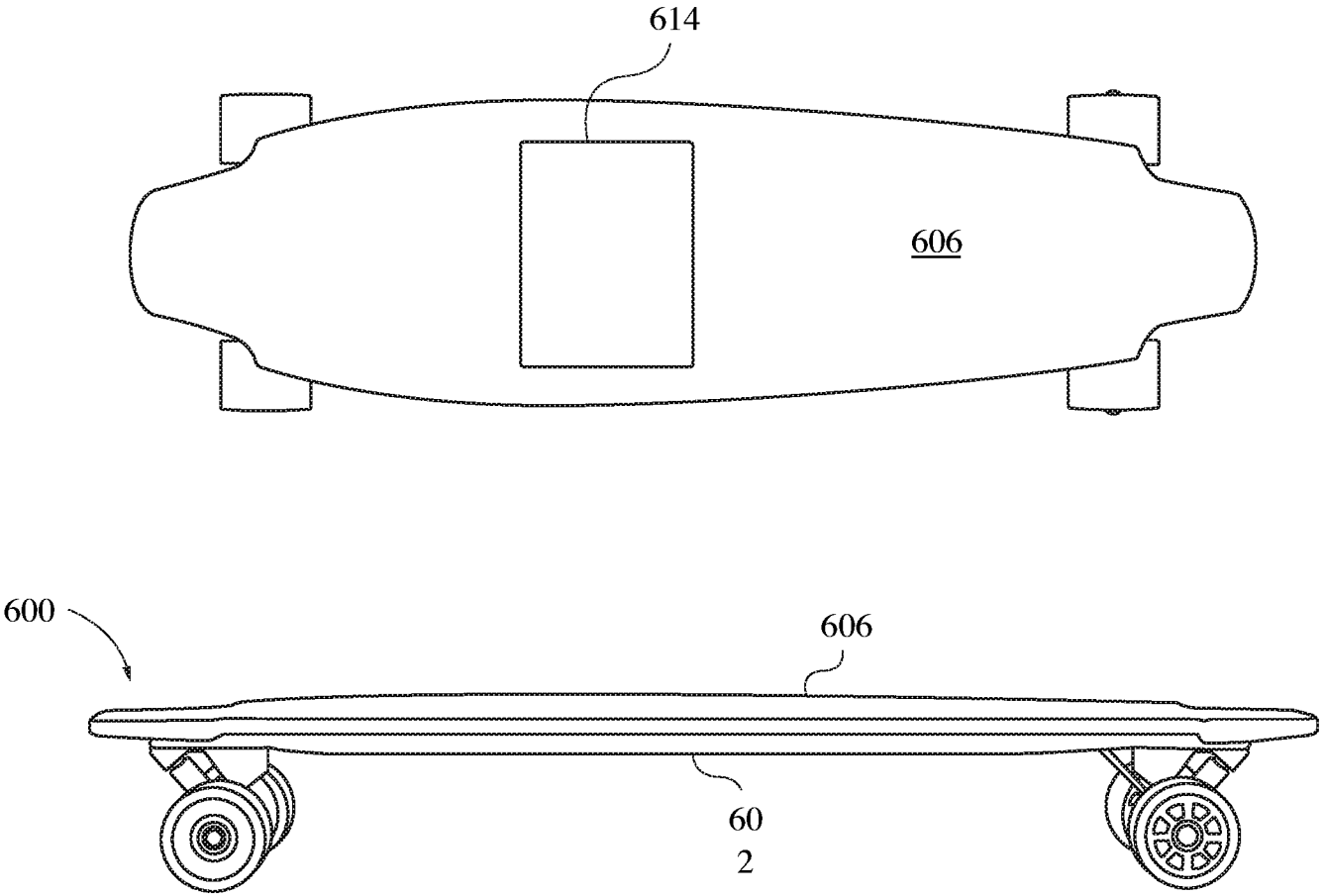
FIG. 7 includes a side view and top view of a powered skateboard, having one or more features consistent with the present description.

FIG. 7 is a schematic view of various elements of a skateboard deck 600, having one or more features consistent with implementations of the current subject matter. The top portion 606 of the skateboard deck 600 can be secured to the bottom portion 602 of the skateboard deck 600. The top portion 606 of the skateboard deck 600 can be secured to the bottom portion 606 of the skateboard deck 600 by one or more of screws, adhesive, welding, mechanically fastening, and/or other securing mechanism. The top portion 606 of the skateboard deck 600 can be contiguous with the bottom portion 602 of the skateboard deck 600. The skateboard deck 600 can have a monocoque structure.

The skateboard deck 600 can comprise injection molded plastic. The skateboard deck 600 can comprise injection molded plastic. The skateboard deck 600 can comprise carbon fiber. The skateboard deck 600 can comprise forged carbon fiber. The skateboard deck 600 can comprise prepreg carbon fiber.

The components of the skateboard deck 600 can have a modular structure. The modular structure can have a polygonal structure. The polygonal structure can be hexagonal or rectangular. The polygonal structure can provide a lightweight structure while maintain strength and stability of the components of the skateboard deck 600.

Figure 8:
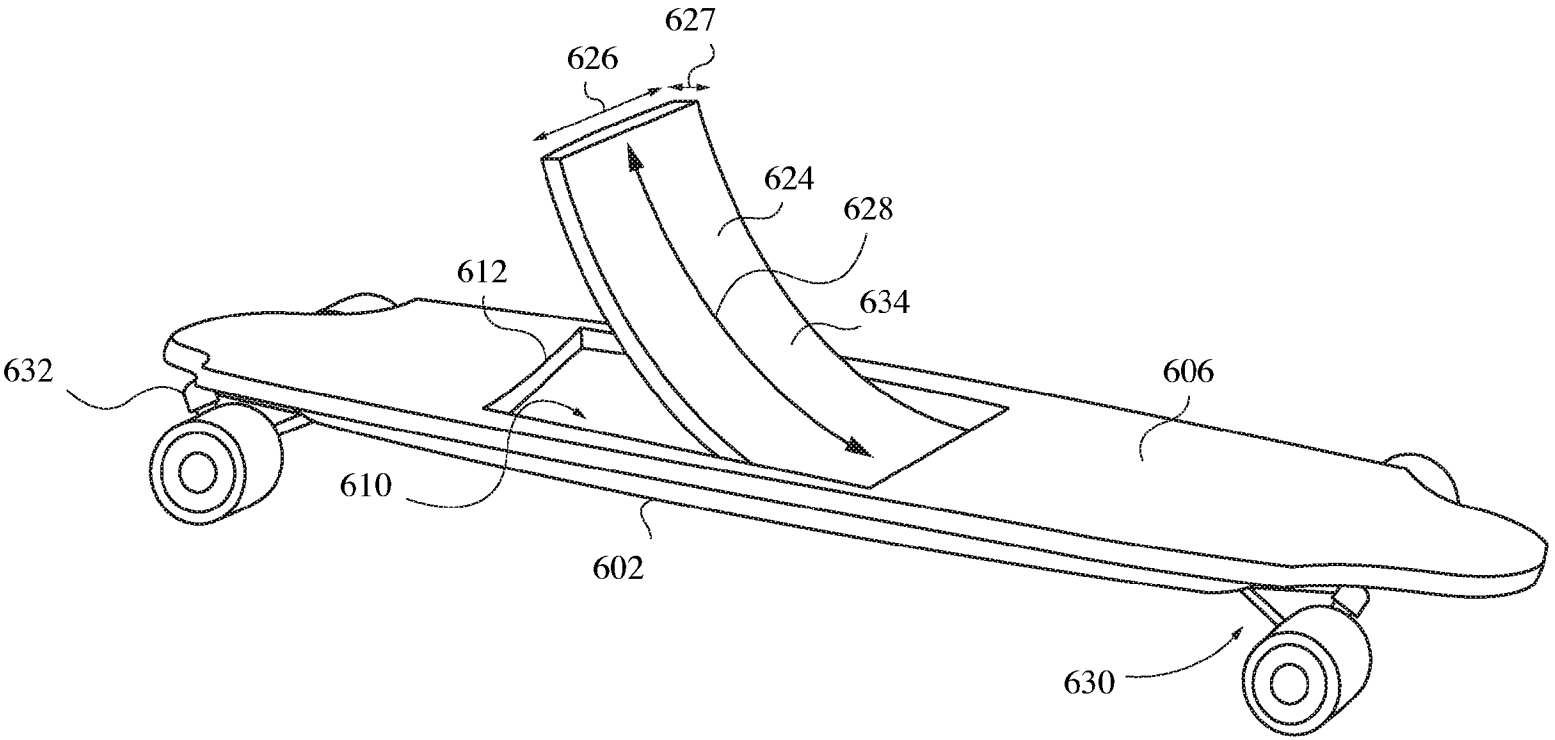
FIG. 8 is a perspective view of a powered skateboard having one or more features consistent with the present description.

FIG. 8 is a schematic view of various elements of the skateboard deck 600, having one or more features consistent with implementations of the current subject matter. The powered skateboard can be electrically powered. The one or more components stored in the cavity 610 between the top portion 606 and the bottom portion 602 can include a power source for providing electric power to one or more electric motors of the electrically-powered skateboard. The power source can include a battery pack 624.

A battery pack 624 contemplated by the current subject matter can be interchangeable. The battery pack 624 contemplated by the current subject matter can have a width 626 suitable to fit within the cavity 610 of the skateboard deck 600 for the presently disclosed powered skateboard. The battery pack 624 contemplated by the current subject matter can have a thickness 127 suitable to fit within the cavity 610 of the skateboard deck 600 for the presently disclosed powered skateboard. The battery pack 624 contemplated by the current subject matter can have a length 628 suitable to fit between the front 630 and back 632 truck mounting portions of the skateboard deck 600. The battery pack 624 contemplated can be configured to be removable from the skateboard deck 600. For example, when a battery pack has been depleted it can be exchanged for a charged battery pack. The battery pack 624 can be flexible to facilitate removing and/or exchanging the battery pack 624 into the cavity 610 of the skateboard deck 600.

Figure 9:
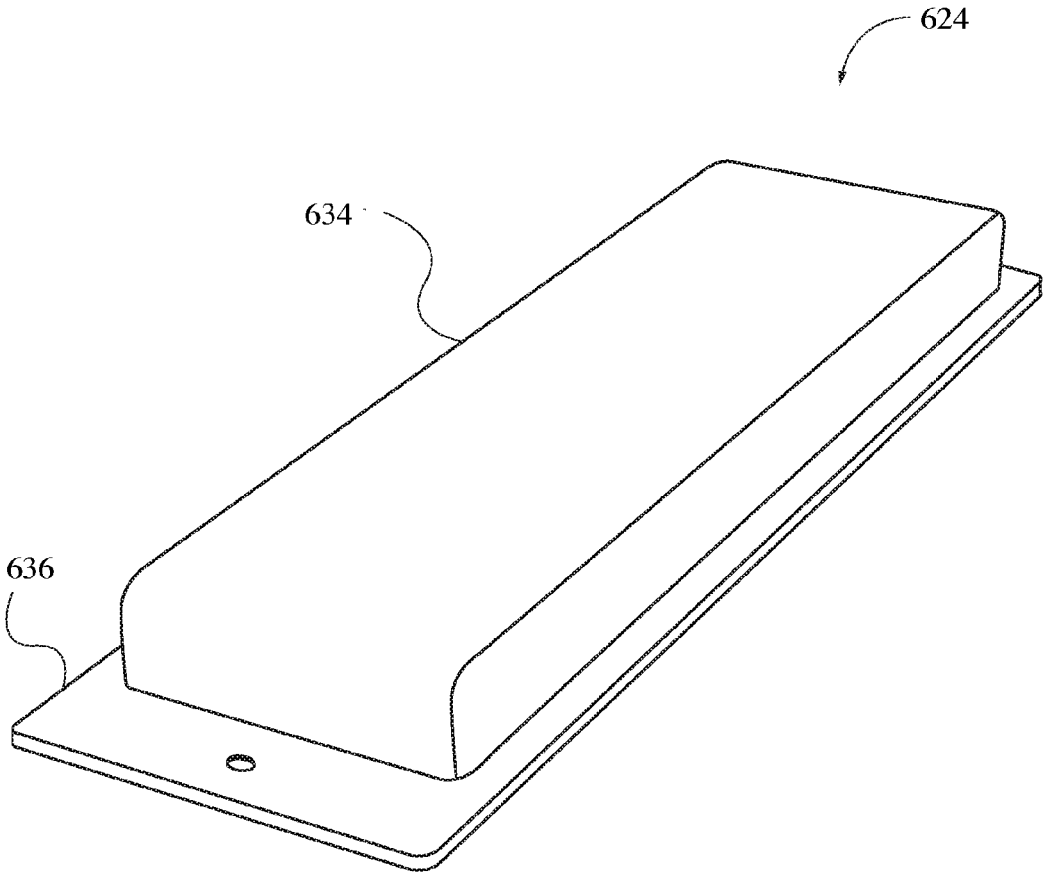
FIG. 9 is a perspective view of a battery pack for use with a powered skateboard having one or more features consistent with the present description.

FIG. 9 illustrates a battery pack 624 having one or more elements contemplated by the current subject matter. The battery pack can have multiple cells. The battery pack 624 can include a casing 634. The casing 634 can have a shape and/or dimensions adapted to secure the battery pack 624 within one or more cavities 610 of the skateboard deck 600. The casing 634 can include a flange 636 encircling the battery pack 624. The flange 636 can be configured to engage with complimentary receiving portions in the cavity 610 of the skateboard deck 600. The flange 636 and complimentary receiving portions can be configured to secure the battery pack inside the cavity 610 of the skateboard deck 600. The lid 614 can facilitate securing the battery pack 624 into the cavity 610 of the skateboard deck.

The current subject matter contemplates multiple different battery packs 624 having different amounts of electrical charge stored in them. The multiple different battery packs can comprise an outer case having substantially similar dimensions. The multiple different battery packs having outer cases having substantially similar dimensions can facilitate the multiple different battery packs to be secured within the cavity of the skateboard deck regardless of the capacity of the battery pack. The cavity within the skateboard deck can be configured to secure different sized battery packs in the cavity.

Figure 10:
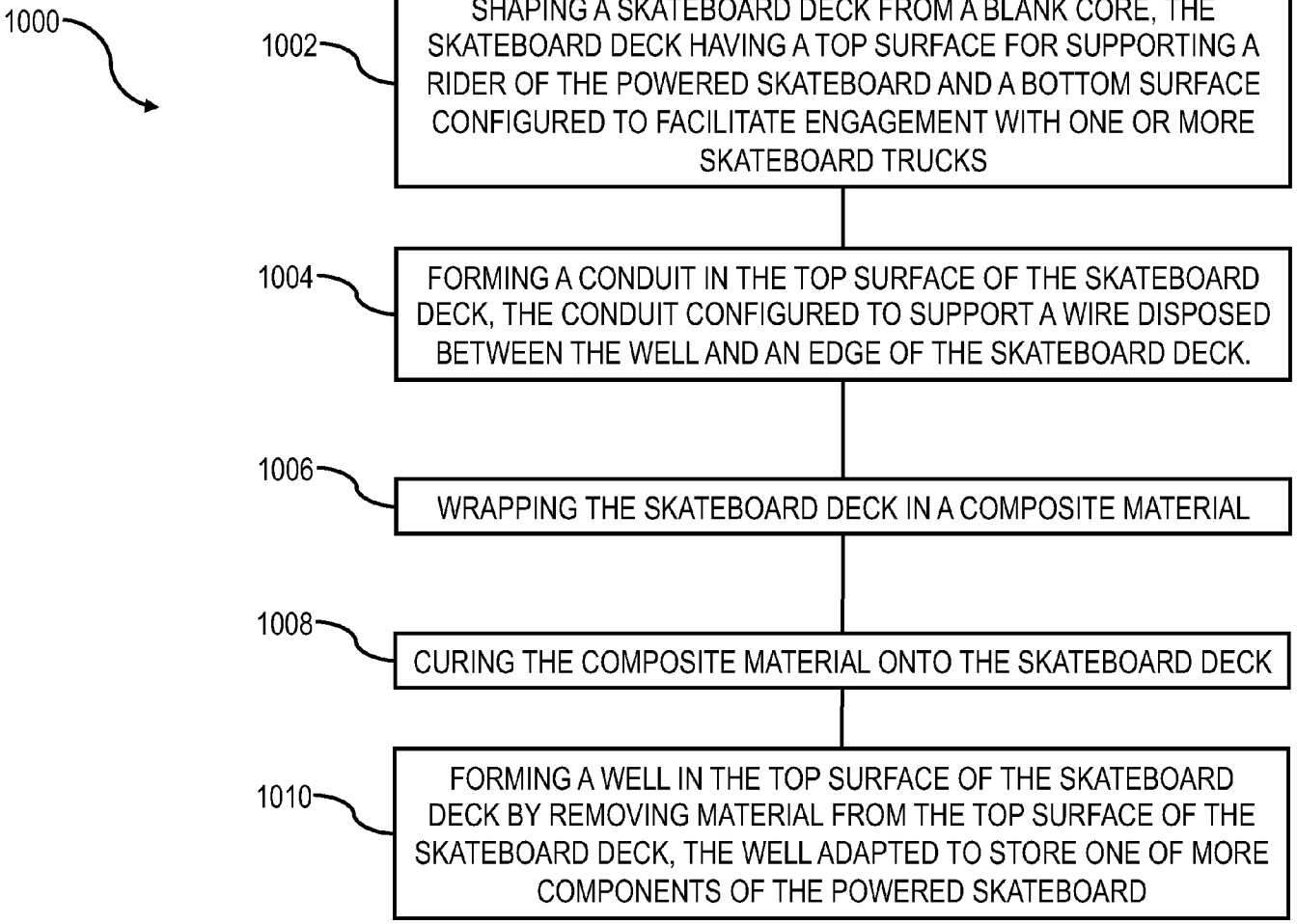
FIG. 10 is a process flow diagram illustrating aspects of a method for making the skateboard deck having one or more features consistent with the present description.

FIG. 10 is a process flow diagram illustrating aspects of a method 1000 for making the skateboard deck having one or more features consistent with implementations of the current subject matter. The method 1000 for making a deck of a powered skateboard can include one or more operations. The order in which the operations of method 1000 are illustrated in FIG. 10 and discussed herein is not intended to be limiting and can be changed where appropriate.

At 1002, a skateboard deck can be shaped from a blank core. The skateboard deck can have a top surface for supporting a rider of the powered skateboard. The skateboard deck can have a bottom surface configured to facilitate engagement with one or more skateboard trucks. The skateboard deck can have a longitudinal size greater than a lateral size of the skateboard deck.

At 1004, a conduit can be formed in the top surface of the skateboard deck. The conduit can be configured to support a wire disposed between the well and an edge of the skateboard deck.

At 1006, the skateboard deck can be wrapped in a composite material. In some variations, the composite material can cover an opening of the conduit formed in the top surface of the skateboard deck. In some variations, reinforcing rails and/or other reinforcing members can be applied to the skateboard deck prior to, or during, the wrapping of the skateboard deck in the composite material. The reinforcing rails can be disposed on the longitudinal side portions of the skateboard deck.

At 1008, the composite material can be cured onto the skateboard deck.

At 1010 a well can be formed in the top surface of the skateboard deck. The well can be formed by removing material from the top surface of the skateboard deck. The well can be adapted to store one of more components of the powered skateboard. In some variations, a well liner can be provided in the well of the skateboard deck. The well can be configured to house one or more components of the powered skateboard. The one or more components of the powered skateboard stored in the well include a power source for the powered skateboard. The one or more components of the powered skateboard stored in the well include a control module for the powered skateboard.

In some variations, a socket can be milled into the skateboard deck for receiving a light, lens, or other electronic equipment.

The method of claim 1, wherein the one or more components of the powered skateboard stored in the well include a control module for the powered skateboard.

A removable well cover can be provided that is configured to cover the opening formed by the well in the surface of the skateboard deck.

Figure 11:
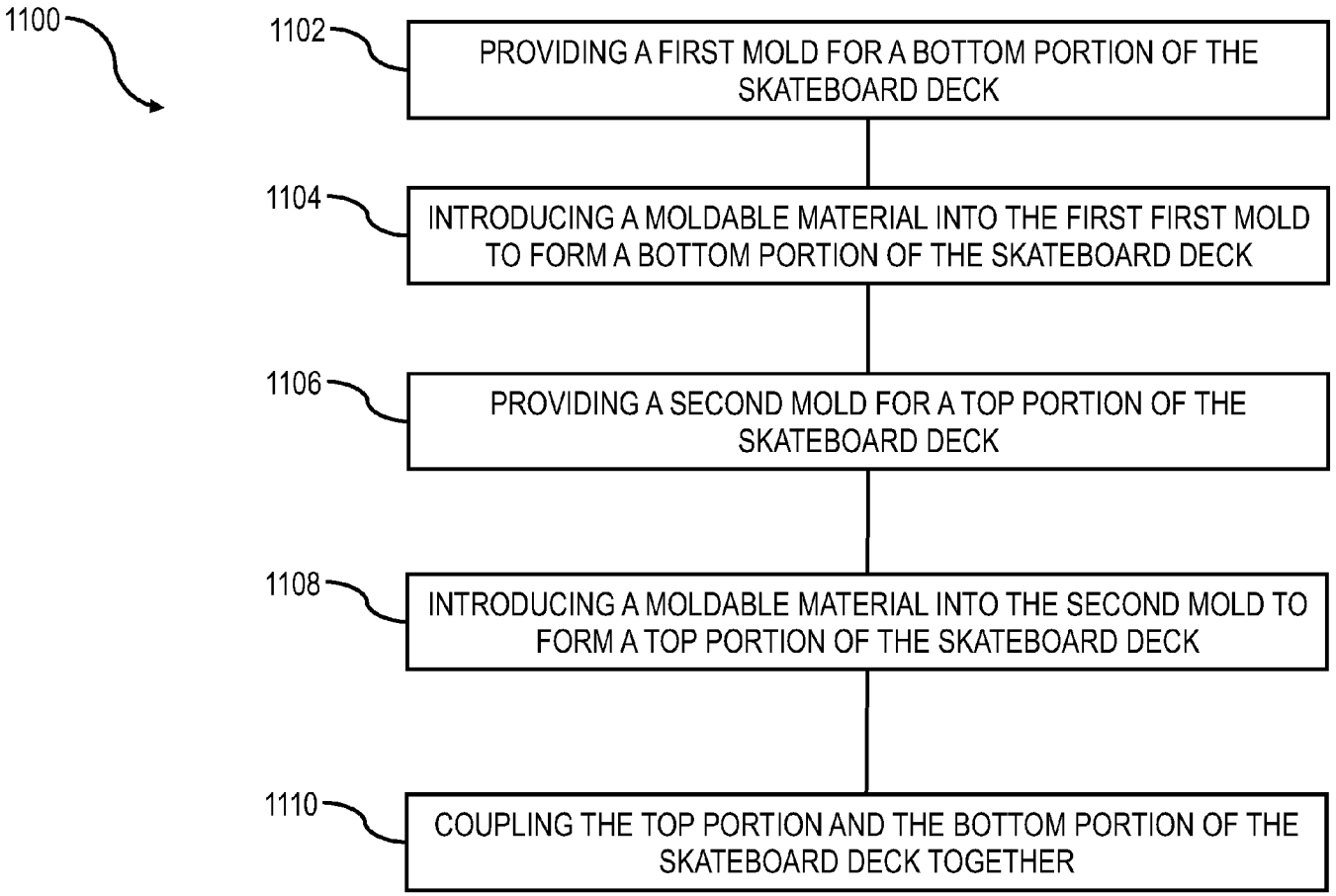
FIG. 11 is a process flow diagram illustrating aspects of a method for making the skateboard deck having one or more features consistent with the present description; and, FIG. 12 is a process flow diagram illustrating aspects of a method for making a skateboard deck having one or more features consistent with the present description.

FIG. 11 is a process flow diagram illustrating aspects of a method 1100 for making the skateboard deck having one or more features consistent with implementations of the current subject matter. The method 1100 for making a deck of a powered skateboard can include one or more operations. The order in which the operations of method 1100 are illustrated in FIG. 11 and discussed herein is not intended to be limiting and can be changed where appropriate.

At an operation 1102 a first mold can be provided for a bottom portion of the skateboard deck. The first mold can provide truck mounting portions. The truck mounting portions can be configured to allow the bottom portion of the skateboard deck to facilitate engagement with one or more skateboard trucks.

At an operation 1104 moldable material can be introduced into the first mold to form a bottom portion of the skateboard deck.

At an operation 1106 a second mold can be provided for a top portion of the skateboard deck. The second mold can be configured to cause the top portion of the skateboard deck to have an upper surface to support a rider of the skateboard.

At an operation 1108 moldable material can be introduced into the second mold to form a top portion of the skateboard deck.

The first mold can be used to create the bottom portion of the skateboard deck from a moldable material. The second mold can be used to create the top portion of the skateboard deck from the moldable material. The first mold and the second mold can be configured to form a cavity between the bottom portion and the top portion of the skateboard deck when the bottom portion and the top portion are coupled together.

At an operation 1110 the top portion and the bottom portion of the skateboard deck can be coupled together by one or more of sonically securing, using screws, using an adhesive, and/or other coupling methods.

Figure 12:
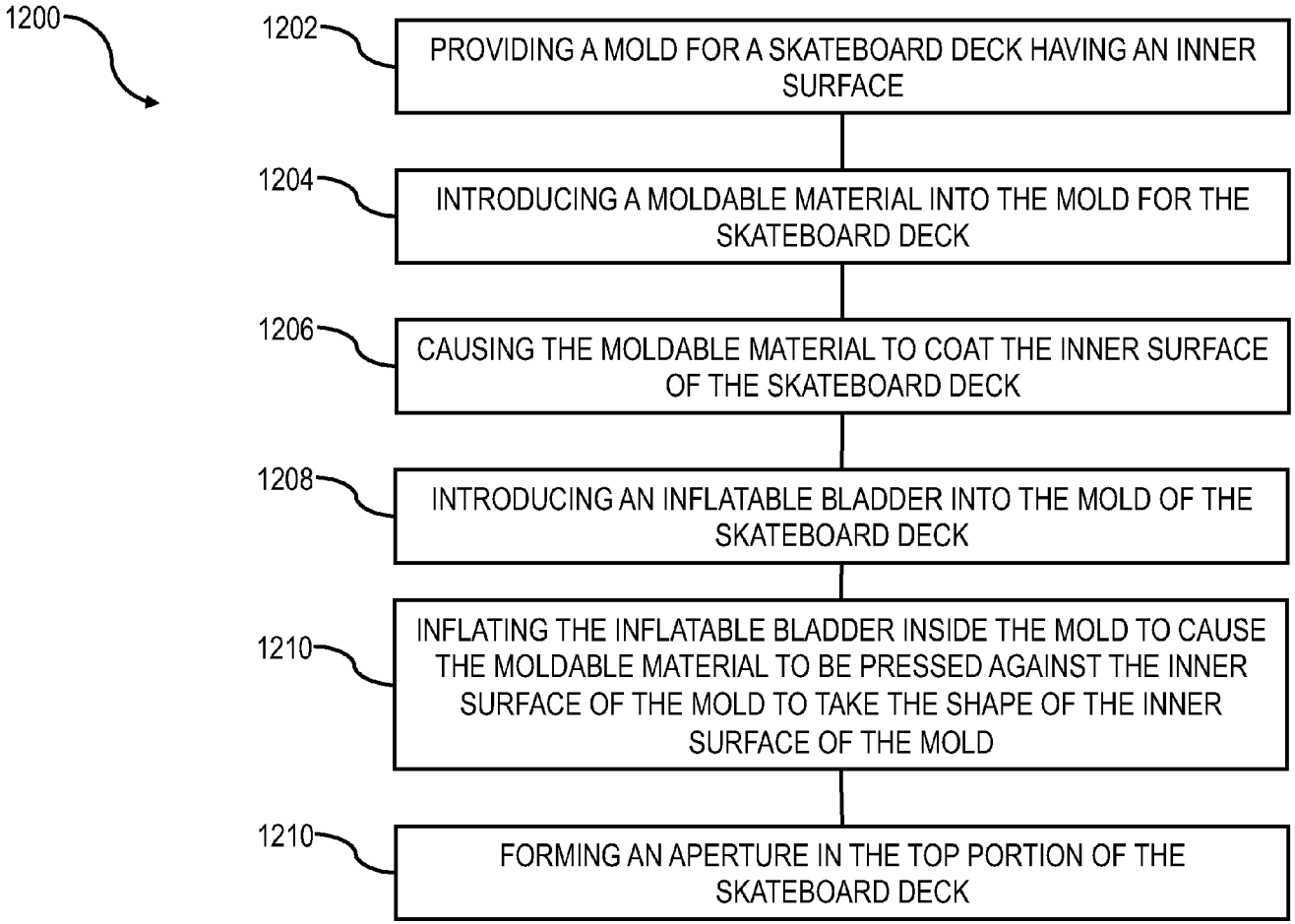

FIG. 12 is a process flow diagram illustrating aspects of a method 1200 for making a skateboard deck having one or more features consistent with implementations of the current subject matter. The method 1200 for making a deck of a powered skateboard can include one or more operations. The order in which the operations of method 1200 are illustrated in FIG. 12 and discussed herein is not intended to be limiting and can be changed where appropriate.

At an operation 1202, a mold for a skateboard deck can be provided, wherein the mold has an inner surface. The inner surface can be configured to facilitate molding of a skateboard deck. The skateboard deck can include a top portion adapted to support a rider of the powered skateboard. The skateboard deck can include a bottom portion having truck mounting portions configured to facilitate engagement with one or more skateboard trucks. The skateboard deck can include a cavity between the top portion and the bottom portion of the skateboard deck.

At an operation 1204, moldable material can be introduced into the mold for the skateboard deck.

At an operation 1206, the moldable material provided at operation 1204 can be caused to coat the inner surface of the mold provided at operation 1202.

At an operation 1208, an inflatable bladder can be introduced into the mold. The mold can have its inner surface coated in the moldable material.

At an operation 1210, the inflatable bladder can be inflated. Inflating the inflatable bladder can cause the moldable material to be pressed against the inner surface of the mold. Pressing the moldable material against the inner surface of the mold can cause the moldable material to take the shape of the inner surface of the mold.

At an operation 1212, an aperture can be formed in the top portion of the skateboard deck.

Various operations of the methods 1100 and 1200 can include heating and/or cooling of the moldable material. Various operations of the method 1100 and the method 1200 can include treating the moldable material before and/or after molding the moldable material to form one or more elements of the skateboard deck.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations can be within the scope of the following claims.

What is claimed is:

1. A system, comprising:

a skateboard deck, the skateboard deck having a top surface for supporting a human rider and a bottom surface configured to facilitate engagement with one or more skateboard trucks;

a well formed in the top surface of the skateboard deck, the well having a well bottom and a well opening opposite the well bottom, the well opening forming an aperture in the top surface of the skateboard deck, the well adapted to at least store one or more components of the system;

a well liner configured to be disposed within the well; and a well cover configured to at least removably cover the well opening, to further support the rider, the well cover comprising guides configured to engage with at least a portion of the well and/or well liner.

2. The system of claim 1, further comprising:

at least one first conduit disposed in the top surface of the skateboard deck and from the well to a front edge of the skateboard deck, the at least one first conduit configured to at least support a first wire disposed in the skateboard deck;

at least one second conduit disposed in the top surface of the skateboard deck and from the well to a rear edge of the skateboard deck;

a first light disposed at the front edge of the skateboard deck and at a first end of the at least one first conduit, the first end of the at least one first conduit being at the front edge of the skateboard deck; and a second light disposed at the rear edge of the skateboard deck and at a second end of the at least one second conduit, the second end of the at least one second conduit being at the rear edge of the skateboard deck.

3. The system of claim 1, further comprising a composite material cured onto the top surface of the skateboard deck.

4. The system of claim 2, further comprising a composite material covering an opening of the at least one first conduit and the at least one second conduit disposed in the top surface of the skateboard deck, the composite material cured onto the surface of the skateboard deck.

5. The system of claim 3, further comprising a socket disposed on an edge of the skateboard deck, the socket configured to receive a light assembly.

6. The system of claim 1, wherein the skateboard deck has a longitudinal size greater than a lateral size and further comprises reinforcing rails attached to at least a portion of the longitudinal edges of the skateboard deck.

7. The system of claim 1, wherein the well liner is configured to be water tight.

8. The system of claim 1, wherein the one or more components of the system stored in the well include a power source for the system.

9. The system of claim 1, wherein the one or more components of the system stored in the well include a control module for the system.

10. The system of claim 8, wherein the well has a first shape and first size and the power source has a second shape complimentary to the first shape and a second size complimentary to the first size, the first shape and the first size and the second shape and the second size causing the power source to fit securely within the well.

11. The system of claim 9, wherein the control module comprises a receiver configured to receive one or more wireless signals, the one or more wireless signals having instructions associated with the operation of the system.

12. The system of claim 1, wherein the well liner comprises:

a first cavity configured to house a power source for powering the system; and a second cavity configured to house a control module for the system.

13. The system of claim 1, further comprising a gasket configured to inhibit the ingress of water into the well, the gasket positioned between the well and the well cover.

14. The system of claim 1, wherein the top surface of the skateboard deck comprises one or more slots configured to engage with the well cover.

* * * * *